US011166612B1

(12) United States Patent
Yang

(10) Patent No.: US 11,166,612 B1
(45) Date of Patent: Nov. 9, 2021

(54) CLEANING APPARATUS

(71) Applicant: Ningbo Troika Science & Technology Company Limited, Ningbo (CN)

(72) Inventor: Jun Yang, Ningbo (CN)

(73) Assignee: Ningbo Troika Science & Technology Company Limited, Ningbo (CN)

( * ) Notice: Subject to any disclaimer, the term of this patent is extended or adjusted under 35 U.S.C. 154(b) by 0 days.

(21) Appl. No.: 16/324,630

(22) PCT Filed: Mar. 12, 2018

(86) PCT No.: PCT/CN2018/078666
§ 371 (c)(1),
(2) Date: Feb. 11, 2019

(87) PCT Pub. No.: WO2019/153408
PCT Pub. Date: Aug. 15, 2019

(30) Foreign Application Priority Data

Feb. 12, 2018 (CN) ..... 201820253943.9

(51) Int. Cl.
*A46B 7/10* (2006.01)
*A47L 11/22* (2006.01)
*A47L 11/40* (2006.01)

(52) U.S. Cl.
CPC ..... *A47L 11/4058* (2013.01); *A46B 7/10* (2013.01); *A47L 11/22* (2013.01); *A47L 11/4041* (2013.01); *A46B 2200/3026* (2013.01)

(58) Field of Classification Search
CPC ..... A46B 7/10; A47L 11/22; A47L 11/4041; A47L 11/4058
See application file for complete search history.

(56) References Cited

U.S. PATENT DOCUMENTS 5,101,532 A * 4/1992 Dyson ..... A47L 9/1633 15/320
2006/0191097 A1* 8/2006 Baumhakel ..... A47L 11/4041 15/320

FOREIGN PATENT DOCUMENTS

CN 201098084 Y 8/2008
DE 102015101339 A1 8/2016

OTHER PUBLICATIONS

Internation Seach Report & Opinion, PCT/CN2018/078666, dated Nov. 13, 2018.

* cited by examiner

*Primary Examiner* — Randall E Chin

(57) ABSTRACT

The invention relates to an apparatus for cleaning. The apparatus comprises a cleaning member adapted to engage a surface to be cleaned; a support member for supporting the cleaning member, with the cleaning member being resiliently movable between an extended position and a retracted position relative to the support member in response to an external force applied to the cleaning member; one or more engaging members provided at the support member; wherein the engaging members are adapted to engage the surface when the cleaning member is arranged at the retracted position such that further retraction of the cleaning member is substantially prevented.

20 Claims, 7 Drawing Sheets

CLEANING APPARATUS

FIELD OF THE INVENTION

This application claims benefit to PCT/CN2018/078666 filed 2018 Mar. 9, which claims priority to Chinese patent application No. CN 201820253943.9 filed 2018 Feb. 12.

The invention relates to a cleaning apparatus and particularly, but not exclusively, to a brush head such as, but not limited to, a brush head for cleaning carpets, rugs, mats or the like.

BACKGROUND OF THE INVENTION

A large variety of cleaning apparatuses or cleaning tools such as, but not limited to, brushes, mops and brooms have been commonly used for removing dirt, dust, debris or the like from the ground or any surfaces that require cleaning. Among the different types of cleaning apparatuses available in the market, a carpet brush is one which generally comprises a plurality of bristles or clusters of bristles for engaging or, more specifically, scrubbing the fabric of the carpet to thereby loosen and subsequently, remove the embedded dirt or hair from the fabric of the carpet. Particularly, different carpet brushes are designed to comprise bristles of different characteristics such as, but not limited to, length, stiffness and/or resiliency for cleaning carpets, mats, rugs or the like of different thicknesses and/or materials. In general, the longer and/or stiffer the bristles of the brush are, the deeper they are able to penetrate into the fabric of the carpet surface and thus the better is the scrubbing or cleaning effect. However, a deeper penetration of the bristles into the fabric may also mean that additional manual effort from the user is required during the clean. In addition, a number of different brushes having bristles with different bristle characteristics may generally be required in a household with more than one type of carpet, rug or mat, which is inconvenient and undesirable.

OBJECTS OF THE INVENTION

An object of the present invention is to provide a cleaning apparatus, in which the aforesaid shortcomings are mitigated or at least to provide a useful alternative.

Another object of the invention is to mitigate or obviate to some degree one or more problems associated with known brushes.

The above object is met by the combination of features of the main claim; the sub-claims disclose further advantageous embodiments of the invention.

One skilled in the art will derive from the following description other objects of the invention. Therefore, the foregoing statements of object are not exhaustive and serve merely to illustrate some of the many objects of the present invention.

SUMMARY OF THE INVENTION

In the first main aspect, the invention provides an apparatus for cleaning. The apparatus comprises a cleaning member adapted to engage a surface to be cleaned; a support member for supporting the cleaning member, with the cleaning member being resiliently movable between an extended position and a retracted position relative to the support member in response to an external force applied to the cleaning member; one or more engaging members provided at the support member; wherein the engaging members are adapted to engage the surface when the cleaning member is arranged at the retracted position such that further retraction of the cleaning member is substantially prevented.

In the second main aspect, the invention provides a carpet brush comprising the apparatus of the first main aspect.

In the third main aspect, the invention provides a vacuum cleaner comprising the apparatus of the first main aspect.

In the four main aspect, the invention provides brush head. The brush head comprises a cleaning member adapted to engage a surface to be cleaned; a support member for supporting the cleaning member, with the cleaning member being resiliently movable between an extended position and a retracted position relative to the support member in response to an external force applied to the cleaning member; one or more engaging members provided at the support member; and a handle retaining means provided at the support member for receiving a handle; wherein the engaging members are adapted to engage the surface when the cleaning member is arranged at the retracted position such that further retraction of the cleaning member is substantially prevented.

The summary of the invention does not necessarily disclose all the features essential for defining the invention; the invention may reside in a sub-combination of the disclosed features.

BRIEF DESCRIPTION OF THE DRAWINGS

The foregoing and further features of the present invention will be apparent from the following description of preferred embodiments which are provided by way of example only in connection with the accompanying figures, of which.

DESCRIPTION OF PREFERRED EMBODIMENTS

Figure 1:
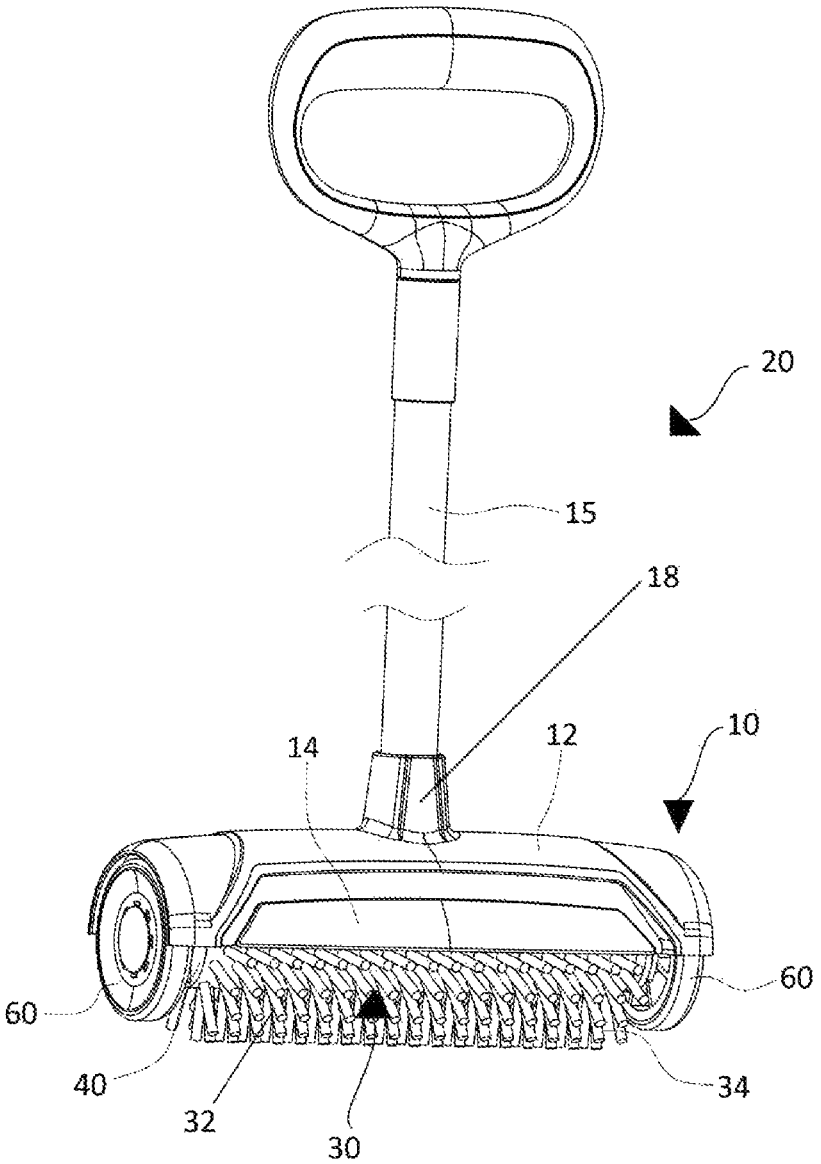
FIG. 1 is a perspective view showing a cleaning apparatus provided in the form of a carpet brush in accordance with an embodiment of the present invention.
Figure 2:
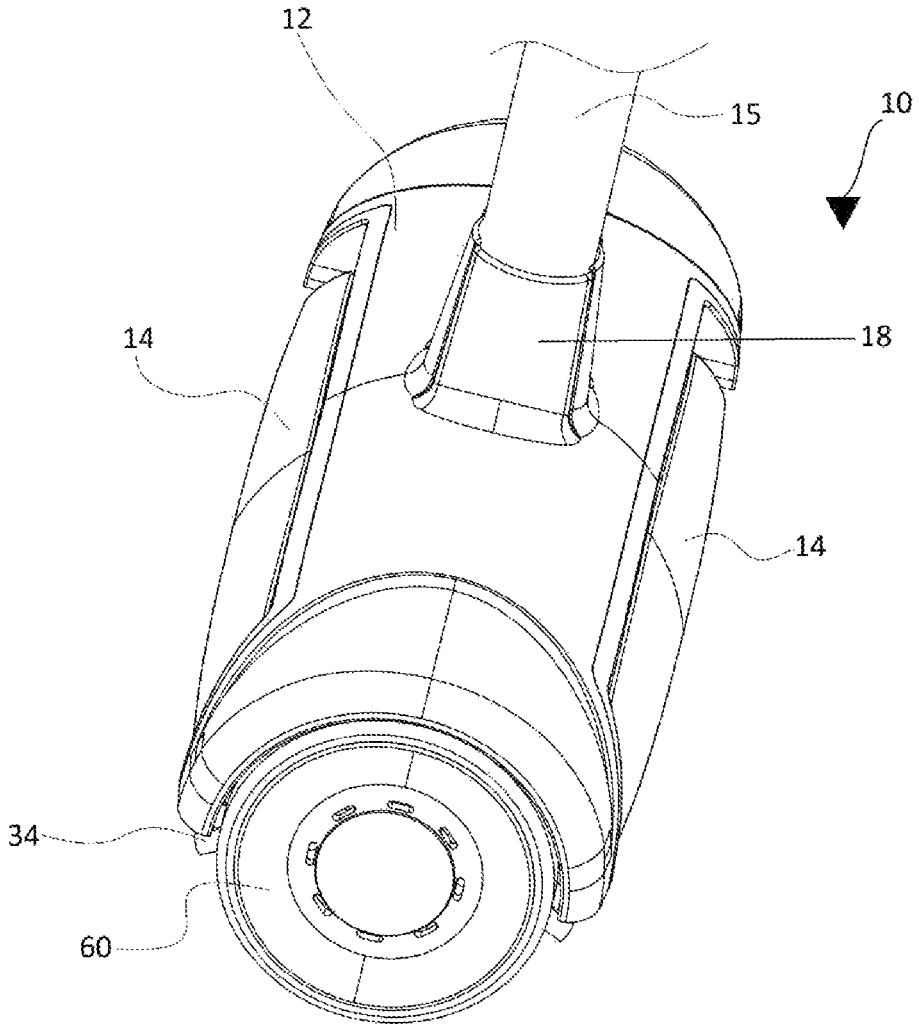
FIG. 2 is another perspective view of the cleaning apparatus of FIG. 1 showing the brush head.

The following description is of preferred embodiments by way of example only and without limitation to the combination of features necessary for carrying the invention into effect.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments.

In the claims hereof, any element expressed as a means for performing a specified function is intended to encompass any way of performing that function. It is thus regarded that any means that can provide those functionalities are equivalent to those shown herein.

The present invention generally relates to a cleaning apparatus or a cleaning tool for collecting and/or removing any dirt, dust, debris, hair, rubbish or the like from the ground, the floor or any surfaces to be cleaned. The cleaning apparatus can be provided in any applicable form of tools, such as but not limited to, a portable hand brush or scrub to be hand-held by the user in use, or a brush having a brush head fixedly and/or detachably connected to an extended and/or elongated handle for easy holding by the user in a standing posture. The cleaning apparatus may also be provided in the form of a brush head having a connector or an adaptor for a releasable connection with a handle, such that the brush head can be easily detached and be replaced when it is worn-out. The releasable brush head may further be configured for connecting with a suitable part of another cleaning apparatus, such as but not limited to, a suction pipe of a vacuum cleaner, to thereby allow interchangeability of different types of brush heads for the vacuum cleaner to perform cleaning on different surfaces.

Referring to FIGS. 1 to 5, shown is a cleaning apparatus 10 provided in the form of a brush head 10 in accordance with an embodiment of the present invention. In this embodiment, the brush head 10 can be fixedly or releasably connected with a handle portion 15 to form a brush 20. The brush head 10 may comprise a cleaning member 30 adapted to engage the surface to be cleaned. In one embodiment, the cleaning member 30 may comprise one or more brush portions 32 each having a plurality of bristles or clusters of bristles 34.

In one specific embodiment, the cleaning member 30 can be configured to be substantially cylindrical in shape, and/or to comprise a curved portion at the surface of the cleaning member 30 carrying the one or more brush portions 32, as shown in the figures. However, a skilled person in the art would understand that any variations to the cleaning member 30 in terms of, for example, size, configuration, construction and/or material, are also encompassed as long as the variations are considered suitable and applicable without departing from the inventive concept of the present invention. For example, in one embodiment, the cleaning member 30 is configured to be releasably mountable at a part or a body of the cleaning apparatus 10 via any known and/or applicable connecting or engaging means provided at two distal ends of the cylindrical body, for example.

The brush head 10 may further comprise a support member 40 for supporting the cleaning member 30. Particularly, the cleaning member 30 can be arranged such that it is resiliently movable between an extended position and a retracted position relative to the support member 40 in response to an external force applied to the cleaning member 30 by the user, for example, by pressing the brush head 10 towards the surface to be cleaned via the handle portion 15. In one embodiment, the resilient movement between the cleaning member 30 and the support member 40 can be provided or assisted by one or more resilient means 50, such as but not limited to, one or more spring members 50 connecting the cleaning member 30 with the support member 40. In such arrangement, the cleaning member 30 can be made naturally biased towards the extended position by the spring members 50, with the cleaning member 30 being resiliently forced to extend away from the supporting member 40. The extension of the cleaning member 30 away from the supporting member 40 allows the bristles or clusters of bristles 34 be operated at their full length. When an external pushing or pressing force is applied by the user onto the cleaning member 30 towards the surface, the cleaning member 30 may then resiliently retract backward to the support member 40 by a compressing action on the resilient means 50. The retraction of the cleaning member 30 towards the support member 40 thus shortens the operable length of the bristles or clusters of bristles 34 available for the scrubbing or cleaning.

In one embodiment, the one or more brush portions 32 can be connected to the support member 40 via one or more respective resilient means 50 to thereby provide independent resilient movement of the one or more brush portions 32 relative to the support member 40. The resilient means 50 acting on the respective brush portions 32 can be of the same or different resiliencies, such that different degrees of resilient retraction, i.e. different operable length of the bristles or clusters of bristles 34, can be provided upon application of the external pushing or pressing force by the user.

In one further embodiment, one or more of the bristles or clusters of bristles 34 may also be adapted to connect to the support member 40 via one or more respective resilient means 50 having the same or different resiliencies. This, again, allows the bristles or clusters of bristles 34 to be independently and resiliently movable between the extended position and the retracted position to thereby provide further variations to the degree retraction and thus, operable length of the bristles or clusters of bristles 34 of the cleaning member 30.

In yet another embodiment, the bristles or clusters of bristles 34 can be configured to have identical stiffness or different stiffnesses and/or be formed of the same or different materials. The difference in stiffnesses of the bristles or cluster of bristles 34 together with the variation of operable lengths of the bristles or cluster of bristles 34 due to the variation of resiliencies of the resilient means 50 are advantageous in offering a broad spectrum of bristles characteristics suitable for cleaning different types of surfaces, such as carpets of different thicknesses, constructions and/or materials including different types of fabrics used, for example.

Figure 3:
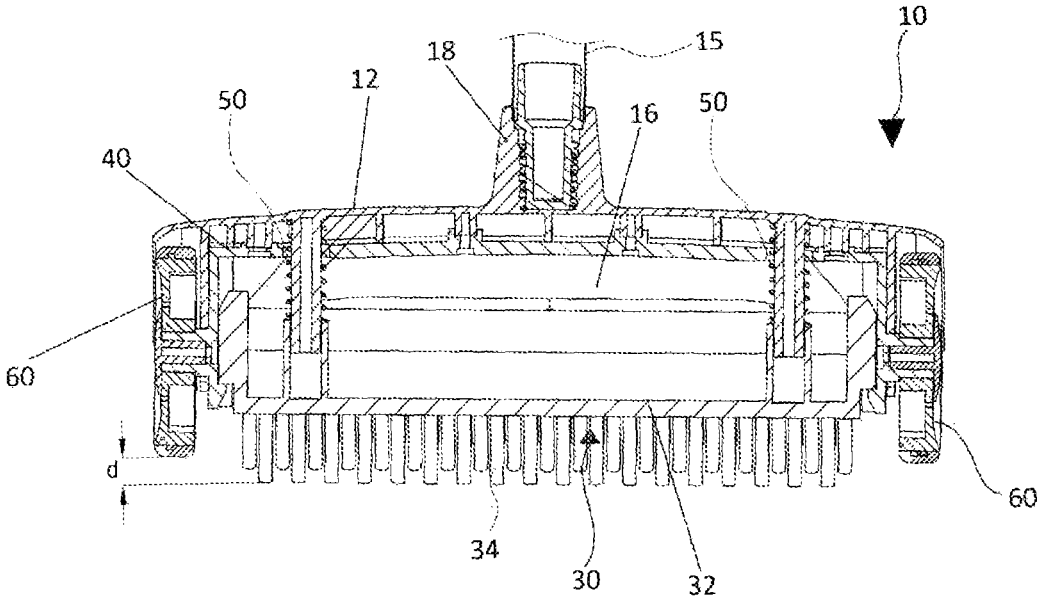
FIG. 3 is a side, cross-sectional view showing the brush head of FIG. 2.
Figure 4:
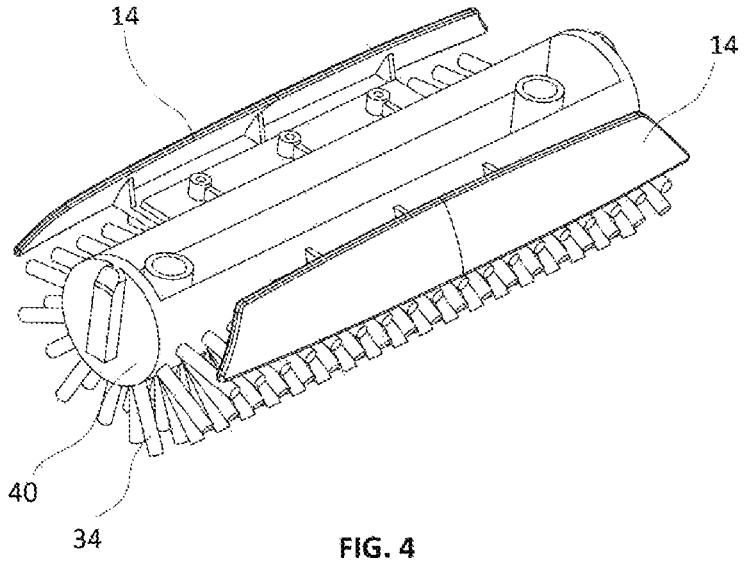
FIG. 4 is a partial, perspective view of the brush head of FIG. 2.
Figure 5:
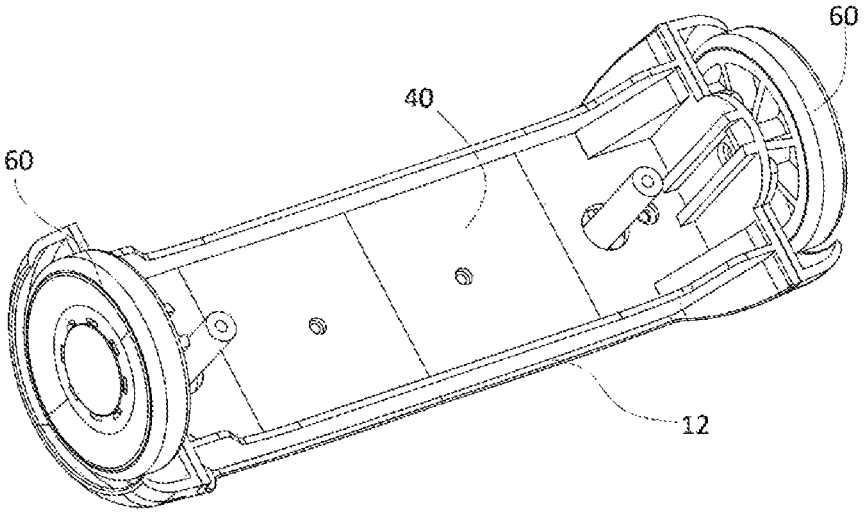
FIG. 5 is another partial, perspective view of the brush head of FIG. 2.

The brush head 10 may further comprise one or more engaging members 60 provided at, for example, the support member 40. Particularly, the engaging members 60 are adapted to engage the surface when the cleaning member 30 is arranged at the retracted position, such that any further retraction of the cleaning member 30 is substantially prevented. When the cleaning member 30 is arranged at the extended position, for example, as shown in FIGS. 1 and 3, the engaging members 60 are arranged to position above the surface or, more specifically, lifted above the surface by the extended cleaning member 30 by a distance "d", as shown in FIG. 3, for example.

In use when scrubbing a relatively thick carpet and/or when a deeper penetration of the bristles or clusters of bristles 34 into the carpet are desired, the user may use the brush head 10 or the carpet brush 20 without applying additional force to press the brush head 10 towards the surface. The cleaning member 30 will remain in its extended position with the bristles 34 arranged at their full operable length to thereby lift the engaging means 60 above the surface by the distance "d". On the other hand, when the brush head 10 or the carpet brush 20 is for use with a relatively thin carpet and/or a carpet with delicate fabric, and that a reduced degree of scrubbing is desired, the user may simply press the brush head 10 and thus the cleaning member 30 towards the surface to thereby compress the resilient means 50. The cleaning member 30 will then be retracted resiliently and inwardly towards the support member 40 at the retracted position. As a result, the bristles 34 will be operated at their shortened operable lengths, with the engaging means 60 being descended over the distance "d" to engage the carpet surface.

The engagement of the engaging mean 60 with the carpet surface is particularly useful in maintaining or restricting the degree of retraction of the cleaning means 30 to thereby control the operable length of the bristles 34 at their optimum during a scrub. The engaging means 60 also provide a simple, physical guide or control for the user to easily rely on so as to achieve and maintain an optimum operable length of the bristles 34 and thus an improved cleaning efficiency, and to avoid any over-pressing on the brush head 10 by accident. In the embodiment as shown in the figures, the engaging means 60 is preferred to comprise one or more rotating means such as one or more wheel members 60 to allow a rotatable engagement with the carpet surface. The prevention of further retraction of the cleaning member 30 beyond the optimum level also helps in avoiding damages of the cleaning member 30, the support member 40, and/or the connecting parts therebetween such as the resilient means 50 by any accidental, overly-exerted pushing or pressing force by the user.

In one embodiment, the brush head 10 may comprise a housing 12 adapted to accommodate the support member 40 and the cleaning member 30. The housing 12 can be configured to define a collecting chamber 16 with the cleaning member 30, with the collecting chamber 16 being opened to the cleaning member 30 to collect and accommodate any received or collected dirt from the cleaning member 30. The brush head 10 or the housing 12 of the brush head 10 may further comprise a cover member 14 adapted to cover at least partially the cleaning member 30 to thereby prevent or reduce fly-off of any collected dirt from the cleaning member 30, especially during a scrubbing action of the user. The brush head 10 or the housing 12 may also comprise a connecting means 18 for releasably connecting the brush head 10 with a handle such as a handle portion 15 as shown in FIG. 1, or a cleaning tool or a part of the cleaning tool such as a suction pipe or a hose of a vacuum cleaner, for example. The releasable connection can be achieved by any known connecting methods, such as via screw connection or frictional engagement, etc. For the connecting means 18 to be adapted to connect with the suction pipe or a hose of a vacuum cleaner, it is preferred for the connecting means 18 be configured to be in fluid communication with the housing 12 and particularly, the collecting chamber 16, such that any collected dusts from the cleaning member 30 which are stored at the collecting chamber 16 can be conveyed via the connecting means 18 to the suction pipe or the hose of the vacuum cleaner and subsequently, be collected and removed by the vacuum cleaner. In one further embodiment, the cleaning member 30 can be configured to be releasably mountable at the support member 40 and/or the housing 12, such that the cleaning member 30 can be easily detached and be replaced when the bristles 34 are worn-out. The releasability of the cleaning member 30 from the support member 40 and/or the housing 12 also allows different cleaning members be interchangeably used at the brush head 10 for performing different cleaning purposes.

Figure 6:
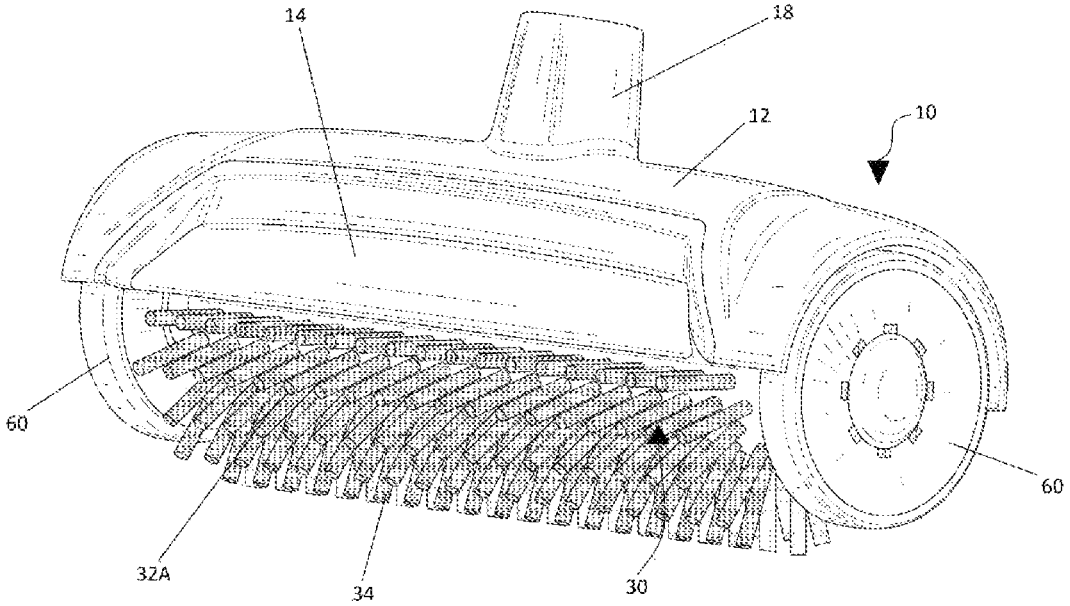
FIG. 6 is a perspective view showing a cleaning apparatus in the form of a brush head in accordance with another embodiment of the present invention.
Figure 7:
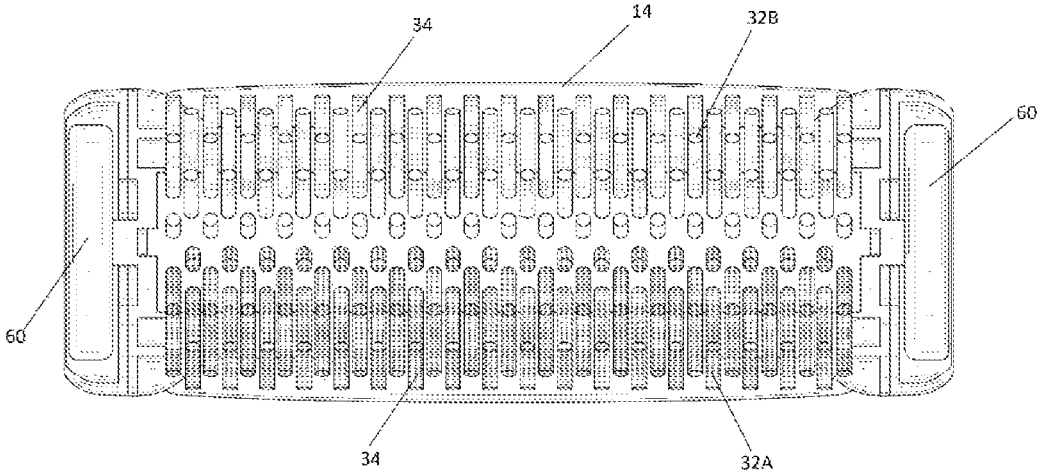
FIG. 7 is a bottom view showing the cleaning apparatus of FIG. 6.
Figure 8:
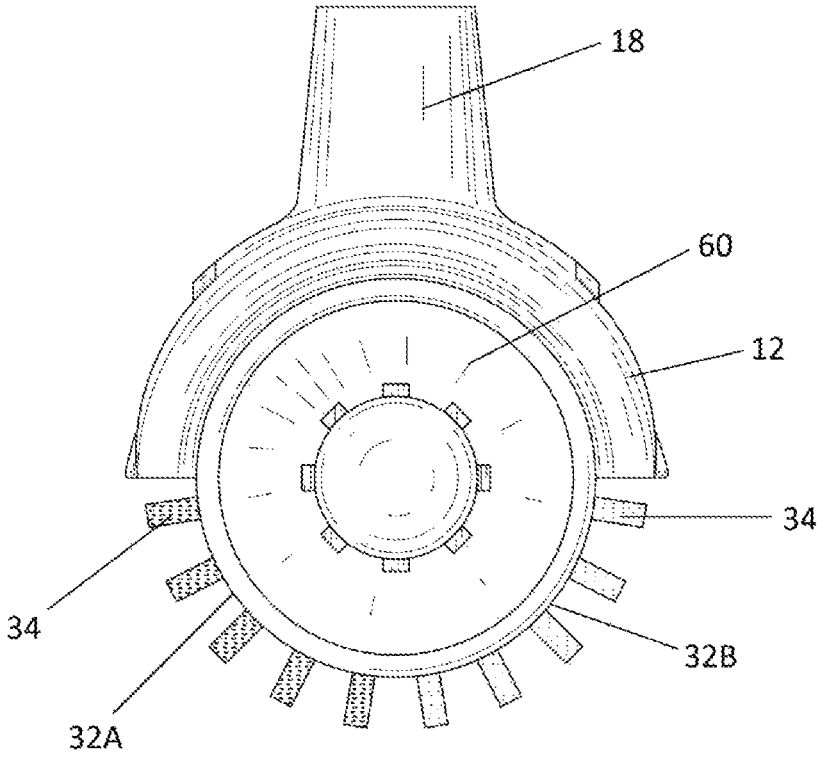
FIG. 8 is a side view showing the cleaning apparatus of FIG. 6.

Referring to FIGS. 6 to 8, shown is another embodiment of the cleaning apparatus 10 in accordance with the present invention. In this embodiment, the cleaning member 30 comprises two brush portions 32A, 32B provided at two opposing longitudinal sides of the cleaning member 30. The two brush portion 32A, 32B each comprises bristles or clusters of bristles 34 with different characteristics such as but not limited to, stiffnesses, resiliencies and/or be formed of different materials. The provision of the two brush portions 32A, 32B at opposing locations is advantageous to allow the user with an easy identifying between the two different bristle types, as well as an easy selecting between the two types of bristles by simply flipping over the brush head 10 from one side to another. Preferably, the bristles 34 of the two brush portions 32A, 32B can be provided in different colors so that the two brush portions 32A, 32B can be visually distinguishable. For example, a darker color can be used to represent bristles with a higher stiffness, and a lighter color can be used to represent bristles with a lower stiffness. Again, a person skilled in the art could readily understand that the present invention shall not be restricted to the specific embodiments described, and any variations to the brush portions and/or the bristles as in, for example, the number, arrangement, configuration, construction and/or material, etc. of the brush portions and/or the bristles of the brush head shall also be encompassed. For example, a brush head of the present invention may comprise more than two, transversely located brush portions, and/or the bristle may comprise a flared end for engaging the carpet, etc., as long as the variations are considered suitable and applicable without departing from the inventive concept of the present invention.

In one further embodiment, the cleaning member 30 may comprise two independently arranged brush portions 32A, 32B each of which being connected to the support member 40 via one or more respective resilient means 50 to thereby provide independent resilient movement of two brush portions 32A, 32B relative to the support member 40. The resilient means 50 acting on the respective brush portions 32A, 32B can be of the same or different resiliencies, such that different degrees of resilient retraction, i.e. different operable length of the bristles or clusters of bristles 34 located at the respective brush portions 32A, 32*b*, can be provided upon application of the external pushing or pressing force by the user. The brush portions 32A, 32B may optionally be configured to be releasably detachable from the support member 40 such that each brush portion can be separately detached and/or be replaced as desired. In one embodiment, the two releasable brush portions 32A, 32B can be configured to carry bristles or clusters of bristles 34 of different stiffnesses, colors and/or be formed of two different materials, etc. which allow different brush portions be interchangeably used for performing different cleaning purposes.

As described above, the cleaning apparatus 10 of the present invention is adapted to be releasably and/or interchangeably connect with a cleaning tool or a part of a cleaning tool such as a handle or a suction pipe of a vacuum cleaner, for example. The present invention therefore may also relate to an apparatus such as a carpet brush, a vacuum cleaner or the like which comprises any one or more embodiments of the clean apparatus 10 as described above.

Without limited by the described embodiments, it will be readily understood by a skilled person in the art that any variations to the cleaning apparatus in terms of, for example, dimensions, configurations, constructions, designs and/or materials forming one or more parts thereof, should also be encompassed by the present invention, as long as the variations are considered suitable and applicable without departing from the inventive concept of the present invention.

The present invention may further relate to a brush head 10. The brush head comprises a cleaning member 30 adapted to engage a surface to be cleaned, and a support member 40 for supporting the cleaning member 30. The cleaning member 30 is configured to be resiliently movable between an extended position and a retracted position relative to the support member in response to an external force applied to the cleaning member, as described above. The brush head 10 may further comprise one or more engaging members 60 provided at the support member 40; and a handle retaining means 18 provided at the support member 40 for receiving a handle 15. The engaging members 60 are adapted to engage the surface when the cleaning member 30 is arranged at the retracted position, such that further retraction of the cleaning member is substantially prevented.

The present description illustrates the principles of the present invention. It will thus be appreciated that those skilled in the art will be able to devise various arrangements that, although not explicitly described or shown herein, embody the principles of the invention and are included within its spirit and scope.

Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

While the invention has been illustrated and described in detail in the drawings and foregoing description, the same is to be considered as illustrative and not restrictive in character, it being understood that only exemplary embodiments have been shown and described and do not limit the scope of the invention in any manner. It can be appreciated that any of the features described herein may be used with any embodiment. The illustrative embodiments are not exclusive of each other or of other embodiments not recited herein. Accordingly, the invention also provides embodiments that comprise combinations of one or more of the illustrative embodiments described above. Modifications and variations of the invention as herein set forth can be made without departing from the spirit and scope thereof, and, therefore, only such limitations should be imposed as are indicated by the appended claims.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It is to be understood that, if any prior art publication is referred to herein, such reference does not constitute an admission that the publication forms a part of the common general knowledge in the art.

The invention claimed is:

1. An apparatus for cleaning, comprising:

a cleaning member adapted to engage a surface to be cleaned;

a support member for supporting the cleaning member, with the cleaning member being resiliently movable between an extended position and a retracted position relative to the support member in response to an external force applied to the cleaning member;

one or more engaging members provided at the support member;

wherein the engaging members are adapted to engage the surface when the cleaning member is arranged at the retracted position such that further retraction of the cleaning member is substantially prevented.

2. The apparatus according to claim 1, wherein the one or more engaging members are arranged above the surface when the cleaning member is at the extended position.

3. The apparatus according to claim 1, wherein, in response to the applied external force, the one or more engaging members are adapted to move towards the surface while the cleaning member is adapted to resiliently retract towards the retracted position.

4. The apparatus according to claim 1, wherein the one or more engaging members comprise one or more rotating means adapted to rotatably engage the surface.

5. The apparatus according to claim 1, wherein the cleaning member is adapted to connect to the support member via one or more resilient means.

6. The apparatus according to claim 1, wherein the cleaning member comprises one or more brush portions each having a plurality of bristles or clusters of bristles.

7. The apparatus according to claim 6, wherein the one or more brush portions are adapted to connect to the support member via one or more respective resilient means.

8. The apparatus according to claim 7, wherein the one or more respective resilient means are of identical resiliency or different resiliencies.

9. The apparatus according to claim 6, wherein one or more of the plurality of bristles or clusters of bristles are adapted to connect to the support member via one or more respective resilient means.

10. The apparatus according to claim 9, wherein the one or more respective resilient means are of identical resiliency or different resiliencies.

11. The apparatus according to claim 6, wherein one or more of the plurality of bristles or clusters of bristles are of identical stiffness or of different stiffnesses.

12. The apparatus according to claim 6, wherein the one or more brush portions comprise two brush portions provided at two opposing longitudinal sides of the cleaning member.

13. The apparatus according to claim 6, wherein a portion of the surface of the cleaning member which carries the one or more brush portions is curved.

14. The apparatus according to claim 1, wherein the cleaning member is releasably mountable at the support member.

15. The apparatus according to claim 1, further comprising a housing adapted to accommodate the support member and the cleaning member.

16. The apparatus according to claim 15, wherein the housing defines a collecting chamber with the cleaning member, with the collecting chamber being opened to the cleaning member to thereby collect and accommodate any collected dirt from the cleaning member.

17. The apparatus according to claim 16, wherein the housing comprises a connecting means adapted to releasably connect the apparatus to a cleaning tool.

18. The apparatus according to claim 17, wherein the connecting means is arranged to be in fluid communication with the collecting chamber.

19. The apparatus according to claim 1, wherein the cleaning member is substantially cylindrical in shape.

20. A brush head comprising:

a cleaning member adapted to engage a surface to be cleaned;

a support member for supporting the cleaning member, with the cleaning member being resiliently movable between an extended position and a retracted position relative to the support member in response to an external force applied to the cleaning member;

one or more engaging members provided at the support member; and a handle retaining means provided at the support member for receiving a handle;

wherein the engaging members are adapted to engage the surface when the cleaning member is arranged at the retracted position such that further retraction of the cleaning member is substantially prevented.

* * * * *